United States Patent [19]

Maeder et al.

[11] 4,300,375

[45] Nov. 17, 1981

[54] TOOL PACK FOR CONTAINER BODY MAKER

[75] Inventors: Edward G. Maeder, Minnetonka County; Harry P. Proctor, Hennepin County, both of Minn.

[73] Assignee: National Can Corporation, Chicago, Ill.

[21] Appl. No.: 137,533

[22] Filed: Apr. 4, 1980

[51] Int. Cl.[3] ..... B21D 22/28

[52] U.S. Cl. ..... 72/45; 72/349

[58] Field of Search ..... 72/347–349, 72/41, 43, 45, 44, 342; 113/120 H; 184/15 R; 118/405

[56] References Cited

U.S. PATENT DOCUMENTS

| | | | |
|---|---|---|---|
| 3,735,629 | 5/1973 | Paramonoff | 72/349 |
| 3,943,740 | 3/1976 | Bartenstein | 72/45 |
| 4,109,502 | 8/1978 | Schaffer | 72/349 |
| 4,148,208 | 4/1979 | Maeder | 72/342 |
| 4,223,544 | 9/1980 | Main | 72/45 |
| 4,262,512 | 4/1981 | Maeder | 72/45 |

*Primary Examiner*—Milton S. Mehr

*Attorney, Agent, or Firm*—Robert A. Stenzel; Ralph R. Rath

[57] ABSTRACT

A tool pack assembly includes three modular units that are aligned with the path for a punch to redraw and iron a cup into a container shell. The first modular unit has a redraw ring assembly, a lubricating ring and an ironing ring serially supported in a support member while the second modular unit has a lubricating ring and an ironing ring in a support member. The third modular unit has a unique lubricant removal ring, a lubricating ring, an ironing ring and a stripper assembly arranged in series in a support member.

11 Claims, 8 Drawing Figures

TOOL PACK FOR CONTAINER BODY MAKER

DESCRIPTION

TECHNICAL FIELD

The present invention relates generally to machines or presses for drawing and ironing metal containers, and more particularly, to a novel tool pack for such a machine.

BACKGROUND PRIOR ART

Various types of machines have been proposed for converting a shallow cup into a drawn and ironed container. Machines of this type usually consist of a punch or ram that is reciprocated along a path on a frame with a plurality of ironing dies arranged along the path. The ironing dies cooperate with the punch to reduce the wall thickness of the shallow cup and increase the height thereof.

One type of machine that has been used for this purpose is disclosed in U.S. Pat. No. 3,735,629. The apparatus disclosed in this patent consists of a redraw assembly, three ironing assemblies and a stripper assembly all arranged along the path for a punch so that a cup can be placed on the end of the punch and then forced through the respective assemblies to decrease the wall thickness and increase the height. At the end of the stroke for the punch, a domer assembly cooperates with the end of the punch to reform the end wall and the finished container is removed from the punch by the stripper assembly while the punch is returned to its original position.

For effective and prolonged operating life, it is essential that proper alignment of the dies and the ram be established and maintained. Various proposals have been suggested for mounting the dies and one type is disclosed in the above-mentioned patent. Each ironing die and the redraw die are mounted in separate cartridges and the respective cartridges are then mounted on the frame of the unit along the axis of movement of the ram or punch. While cartridge-type tool packs are known, some difficulties have been encountered in maintaining accurate alignment between the respective assemblies during installation and subsequent operation.

Another problem encountered during a drawing and ironing operation is the large amount of frictional heat that is developed in the ironing dies as well as the punch and each of the cups being ironed. In order to dissipate this heat, it is customary to supply a lubricant-coolant adjacent each of the ironing dies to transfer the heat from the ironing dies and the periphery of the cup being ironed to the lubricant-coolant. The lubricant-coolant is usually a highly diluted mixture, such as 95% water and 5% synthetic or water soluble lubricant. One type of lubricating means is disclosed in the above-mentioned patent wherein a lubricant ring is located adjacent each of the ironing rings and a large volume of lubricant is supplied thereto and flows out the bottom adjacent each ironing ring.

In a tool pack assembly where all the components are enclosed in a housing, the large volume of lubricant must flow through the open end of the stripper assembly and has a tendency to fill the drawn and ironed container after the punch is withdrawn and before the container is removed from the press.

SUMMARY OF THE INVENTION

According to the present invention, a modular tool pack unit includes three individual units that respectively support the redraw assembly, three ironing assemblies and a stripper assembly as well as lubricating rings for supplying lubricant-coolant (hereafter called lubricant) to the periphery of a cup that is being drawn and ironed.

More specifically, the tool pack assembly includes a first modular unit that has a redraw assembly and one ironing assembly supported therein, a second modular unit that has a second ironing assembly supported therein, and a third modular unit that has the third ironing assembly and the stripper assembly supported therein. The respective units are designed such that the three units can easily be placed in a cavity that is located along the path of movement of a reciprocal punch that cooperates with the redraw and ironing rings to reduce the wall thickness of a cup supported on the punch. Each modular unit also has a lubricant distribution means supported adjacent the leading end of the associated ironing assembly and a lubricant removal ring is located just forwardly or upstream of the last ironing ring so that substantially all previously supplied lubricant is removed to reduce the amount of lubricant that flows through the open end of the tool pack at the end of the ironing operation.

The lubricant removal means or ring consists of a main body that has opposed, generally parallel surfaces with a circular opening extending through the body between the surfaces. The body has a liquid receiving channel surrounding and exposed to the periphery of the opening. The periphery of the channel has a minimum radial dimension at one point and a progressively increasing radial dimension from the first point to a second point with an outlet extending from the channel to the periphery of the body between the two points. The lubricant removal ring also has means for supplying lubricant to the periphery of the cup directly adjacent the spiral chamber at a compound angle to the punch creating a vortex which will expand into the spiral chamber. The centrifugal forces on the lubricant tend to cause the lubricant to flow along the periphery of the chamber to the outlet.

Thus, any lubricant-coolant that has been supplied to the tool pack unit adjacent the first and second ironing rings is removed prior to the cup and punch entering the third ironing ring thereby substantially reducing the amount of lubricant-coolant that flows through the outlet end of the tool pack unit adjacent the domer element supported at that end thereof.

According to the method aspect of the invention, a supply of lubricant is delivered to the periphery of the cup just prior to the cup entering each of the ironing dies and all of the lubricant supplied to the first and second ironing dies is removed prior to the cup entering the last ironing die while a separate supply of lubricant-coolant is provided adjacent the last ironing die which reduces the amount of lubricant-coolant which flows through the open path for the punch.

BRIEF DESCRIPTION OF SEVERAL VIEWS OF DRAWINGS

FIG. 1 of the drawings generally discloses a fragmentary portion of a press or apparatus that is utilized for making drawn and ironed containers;

DETAILED DESCRIPTION

Figure 1:
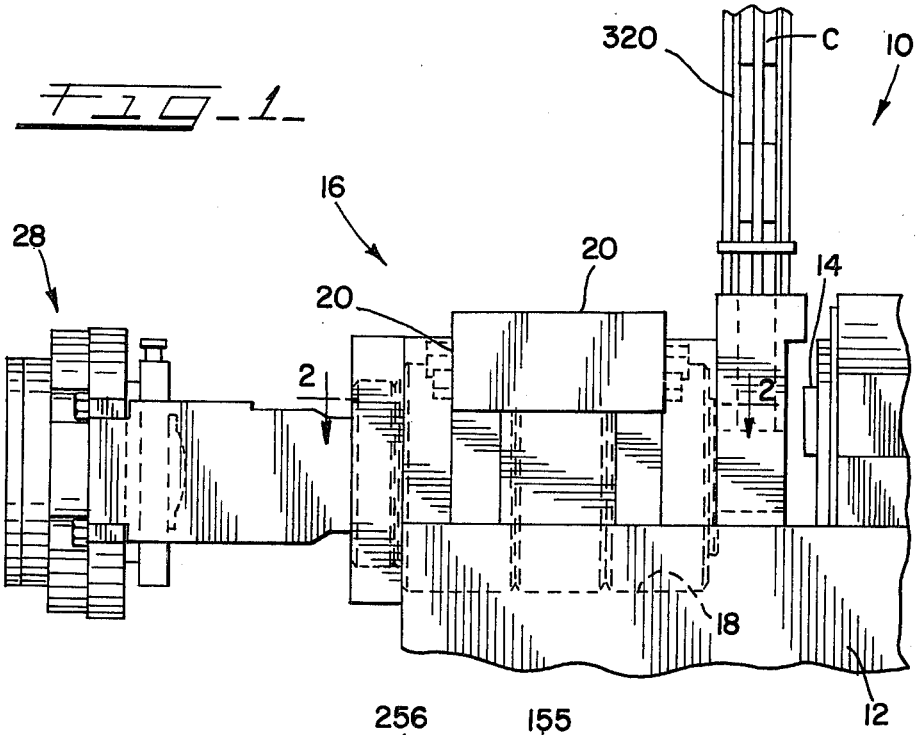

While this invention is susceptible of embodiment in many different forms, there is shown in the drawings and will herein be described in detail a preferred embodiment of the invention with the understanding that the present disclosure is to be considered to be an exemplification of the principles of the invention and is not intended to limit the invention to the embodiment illustrated.

FIG. 1 of the drawings generally illustrates an apparatus for forming metallic container bodies of the type disclosed in U.S. Pat. No. 3,735,629, incorporated herein by reference. The body maker or machine 10 includes a frame 12 which has the various drive components for reciprocating a ram or punch 14 along a predetermined path on the frame. A tool pack assembly, generally designated by reference numeral 16, is located in a cavity 18 defined on the frame 12. Cavity 18 is enclosed by a cover 20 and has reduced recesses 22, 24 at opposite ends thereof. A domer assembly 28 is located at the end of the path of travel for the punch, for a purpose that will be described later.

As explained more fully in the above-identified patent, the punch is capable of picking up a cup and forcing the cup through a redraw ring, a plurality of ironing rings and a stripper assembly and cooperates with the domer assembly at the end of the stroke to reform the end wall of the container shell to a domed configuration. One of the difficulties encountered with a machine of this type is maintaining accurate alignment between the respective ironing assemblies, the redraw assembly and the stripper assembly along the path or axis for the punch.

According to the present invention, the respective dies and the stripper assembly that are utilized for reducing the sidewall thickness of a cup are arranged in modular units so that accurate control can be maintained between the critical relationship of some of the components in the overall tool pack assembly. More specifically, in the illustrated embodiment of the invention, the redraw ring and a first ironing die are located in one modular unit while the second ironing die is located in a second modular unit and the third ironing die and a stripper assembly are located in a third modular unit, all of which are arranged in series and held in a fixed position along a path by the frame of the machine. In addition, each of the modular units has a lubricating means and a fluid bearing associated therewith while one of the modular units also has a unique lubricant removal means to remove substantially all of the lubricant just prior to entry of the partially ironed cup into the last ironing ring of the overall assembly.

Figure 2:
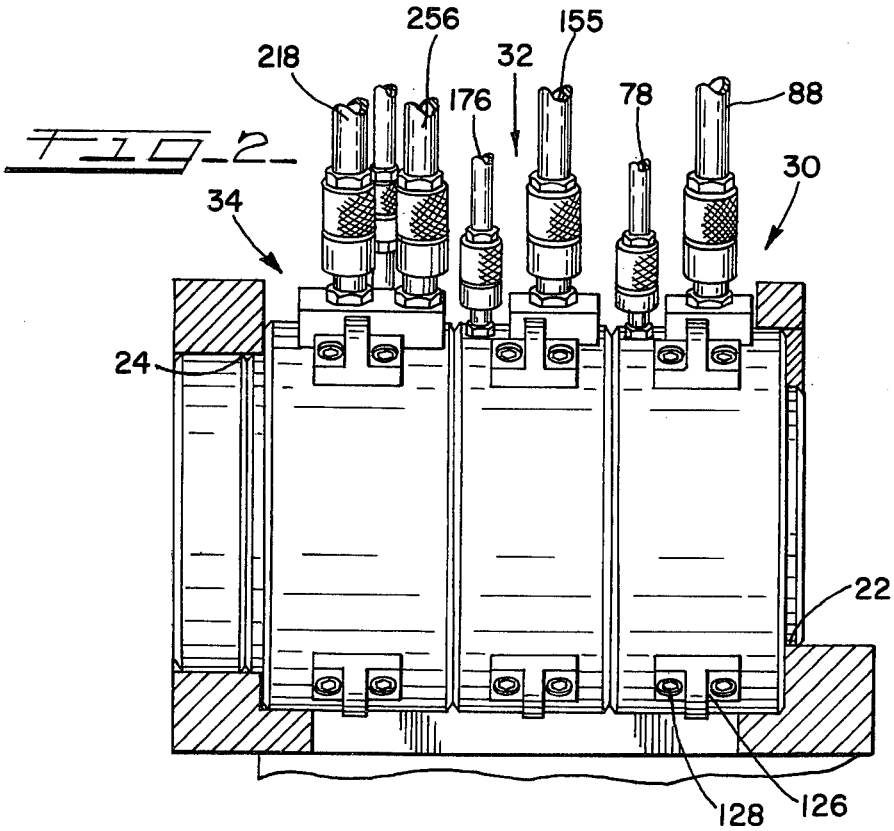
FIG. 2 is an enlarged overall assembly view of the modular tool pack unit constructed in accordance with the teachings of the present invention, as viewed along line 2—2 of FIG. 1.

Referring specifically to FIG. 2, the overall tool pack assembly is illustrated in an assembled condition with a frame structure being schematically illustrated in phantom lines. The tool pack assembly consists of a first modular unit 30, a second modular unit 32 and a third modular unit 34.

Figure 3:
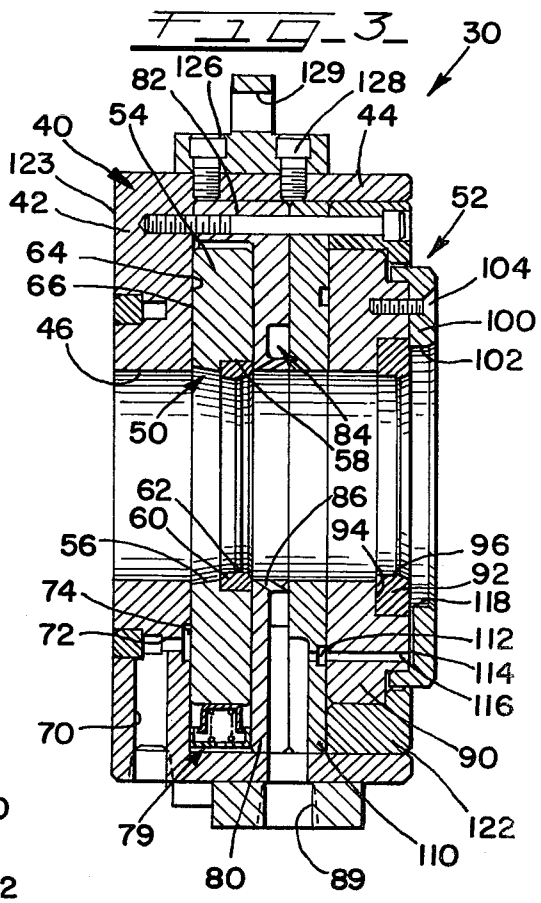
FIG. 3 is a cross-sectional view of the first modular unit showing the internal construction thereof.

The first modular unit 30 is most clearly illustrated in cross section in FIG. 3 and includes a support member 40 that consists of a base portion 42 and an integral annular flange 44 extending from one surface of the base portion. Base portion 42 has a substantially circular opening 46, for a purpose that will be described later. An ironing die assembly 50 and a redraw ring assembly 52 are supported in the cavity defined by annular flange 44. Ironing die assembly 50 includes support ring 54 that has an opening 56 and an annular recess 58 at one end of the opening 56. An ironing ring or die 60 is supported in the recess 58 and has a circular opening 62.

Body portion 42 of support member 40 also has a generally flat surface 64 with the adjacent surface 66 of support member 54 being in sliding contact therewith. A fluid bearing is defined between the surfaces 64 and 66 and includes an inlet opening 70 through body 42 with the inlet opening 70 preferably being connected to a suitable supply of fluid, such as air, by a conduit 78 (FIG. 2). The inner end of the opening 70 is in communication through a plurality of circumferentially spaced openings 72 with an annular recess 74 that extends from surface 64. Thus, fluid supplied from a source through flexible conduit 78 (FIG. 2) connected to the inlet 70 will provide a fluid bearing between surfaces 64 and 66 to accommodate some radial movement of the support ring 54 and ironing die 60. Preferably, the support member and ironing die are maintained in a centered position through a plurality of circumferentially spaced spring assemblies 79 that cooperate with the periphary of support ring 54.

Ironing die assembly 50 also includes a lubricating ring 80 for directing lubricant toward the ironing surface of ironing die 60 which also acts as a coolant for the ironing die and the adjacent surface of the cup that is being ironed. Lubricating ring 80 consists of a main body portion that has an annular flange 82 surrounding ironing die support member 50 with an annular channel 84 defined in the body. A plurality of circumferentially spaced openings 86 extend from annular channel 84 and have their axes inclined to provide a flow path that is generally toward the peripheral ironing surface of ironing die 60. For example, 24 of such openings could be equally spaced around the perimeter of the opening in the lubricating ring 80. Thus, lubricant supplied from a source through a conduit 88 (FIG. 2) connected with inlet opening 89 will provide a lubricant-coolant flow to the ironing die and the periphery of the cup that is being ironed.

Redraw ring assembly 52 again includes a support member 90 that has an opening therethrough and has a redraw ring 92 supported in an annular recess 94 and has an opening 96. Redraw die assembly 52 also includes a mechanism for controlling the cup while it passes through the redraw ring. The centering mechanism includes a nesting ring 100 that has an opening 102 which is substantially larger than the opening 96 in the redraw ring 92. The nesting ring 100 is secured to support ring 90 through a plurality of set screws 104. The nesting ring prevents the upper edge of the cup from flaring out during the last phase of the redraw operation.

In order to reduce friction between the surface of the cup and the redraw ring, lubricating means is applied to the exposed surface of the ring which initially supports the cup, and to the adjacent surface of the cup. As most clearly illustrated in FIG. 3, this lubricant is supplied from a common source, which supplies lubricant to channel 84, and consists of a spacer ring 110 that has an annular channel 112 defined in one surface thereof. Annular channel 112 is closed by the adjacent surface of support member 90 and is in communication with a further channel 114 in nesting ring 100 through a plurality of openings 116. Channel 114 is in communication with the peripheral opening 102 in nesting ring 100 through a plurality of radially extending recesses 118. With this arrangement, lubricant can simultaneously be supplied to both the peripheral surface of the redraw ring 92 as well as into the area between the peripheral surface of the cup and the ironing die 60 through a single supply source defined by conduit 88.

The respective components that form the first modular unit 30 are all held in a fixed position through a plurality of screws 120 that extend through openings in an annular cap 122 and lubricating rings 80 and 110.

It should be noted that the peripheral surface of the nesting ring 100 extends beyond the peripheral upper surface of the annular flange 44 as well as the adjacent surface of the cap 122 so that a circumferential surface is exposed. This circumferentially exposed surface is adapted to be received into recess 22 at one end of cavity 18 to securely position the entire modular unit with respect to the path or axis for the punch while an opposite exposed flat surface 123 extends substantially perpendicular to the path. The peripheral surface to support member 40 also has a pair of circumferentially spaced ears 126 secured thereto by screws 128 and has an opening 129 therein, for a purpose to be described later.

Figure 4:
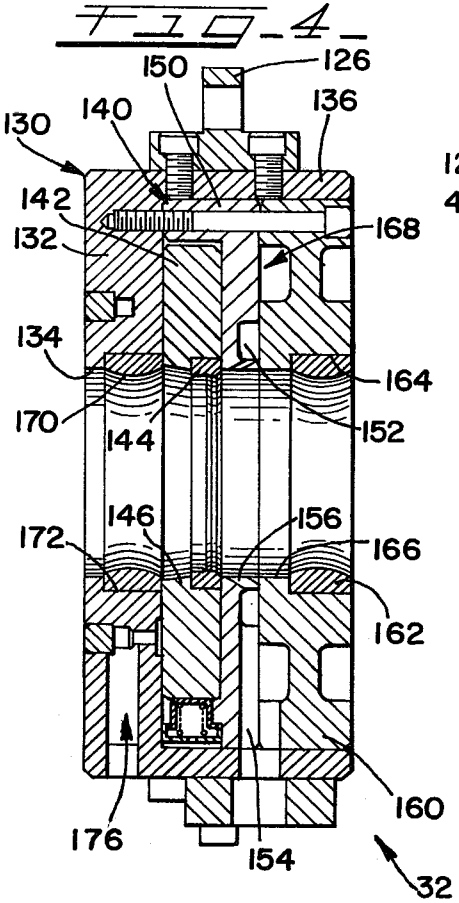
FIG. 4 is a cross-sectional view showing the details of the second modular unit.

The second modular assembly 32 is illustrated in FIG. 4 and again includes a support member 130 that has a main body portion 132 having an opening 134 therein. The main body portion 132 has an annular flange 136 extending from the periphery of one surface. The annular flange and body portion cooperate to define a substantially circular cavity or chamber which has an ironing die assembly 140 that is substantially identical to ironing die assembly 50. Ironing die assembly 140 includes a support member 142 that has an ironing die 144 supported in opening 146. The assembly also includes a lubricating ring 150 that has a lubricating channel 152 which has lubricant supplied thereto through an inlet 154 by a conduit 155. (FIG. 2) Channel 152 has a plurality of outlet orifices 156 that are directed toward the ironing surface of ironing die 144.

A further support ring 160 has a surface engaging lubricating ring 150 and closes off the open exposed area of channel 152. The support ring 160 also has a protective anvil 162 located in an annular recess 164 surrounding opening 166 in the center of the support ring. In addition, a further lubricating channel 168 is defined around the peripheral portion of support ring 160 and is supplied with lubricant-coolant from the same source as channel 152.

A further protective anvil 170, similar to anvil 162, is located in a recess 172 around opening 134 in support member 130. The purpose of protective anvils 162 and 170 will be described later. Support member 130 also has a fluid bearing supply means 176 which is identical to the fluid bearing means supplied by conduit 78 described in connection with the first modular unit 30 and a pair of ears 126 are secured to the peripheral surface thereof. The support member 130 also has flat opposed end surfaces 178 that extend perpendicular to the axis for opening 134.

Figure 5:
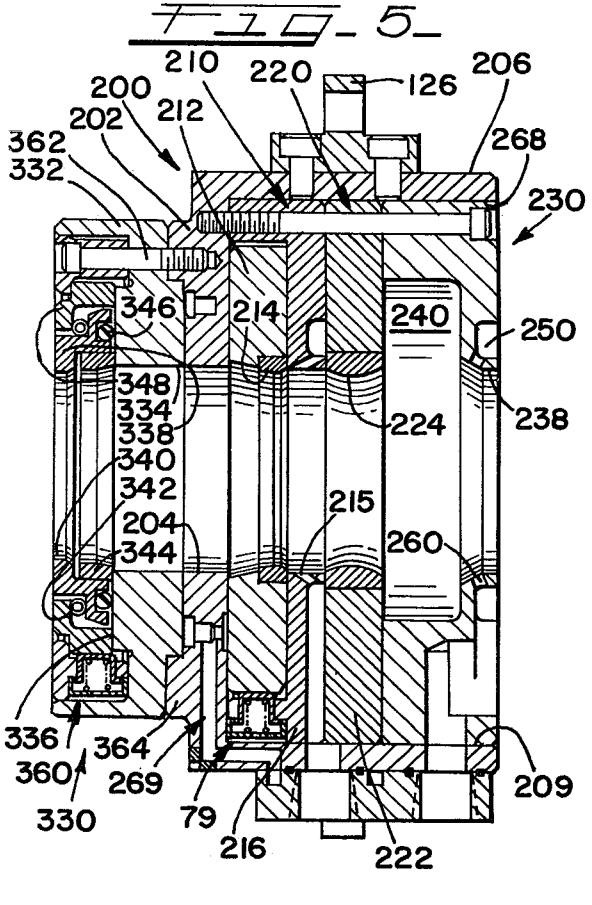
FIG. 5 is a cross-sectional view showing the internal details of the third modular unit.

The third modular unit 34 is illustrated in FIG. 5 of the drawings and consists of a support member 200 including a main body portion 202 having a circular opening 204 and an annular flange 206 extending from the peripheral surface thereof defining a cavity 209. A third ironing die assembly 210, including a support member 212 having an ironing die 214 supported thereon is located in the base of cavity 209. A lubricating ring 216 (indentical to lubricating ring 80) is supported adjacent the exposed surface of support member 212 and has lubricant supplied thereto through conduit 218 and openings 215. A further guide member or assembly 220 consisting of a support member 222 and a protective anvil 224 are located adjacent the lubricating ring 216.

Figure 7:
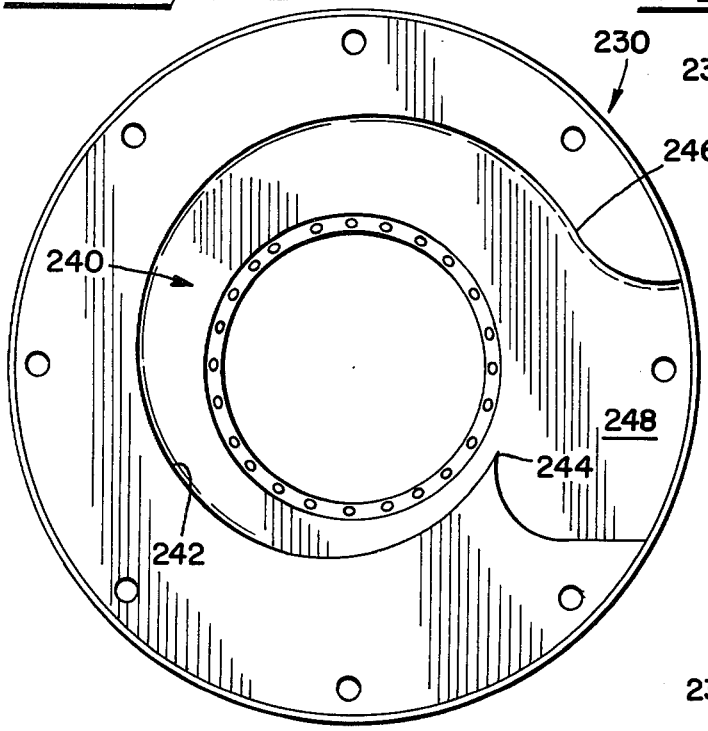
FIG. 7 is a plan view of the lubricant removal ring, as viewed along line 7—7 of FIG. 6.
Figure 6:
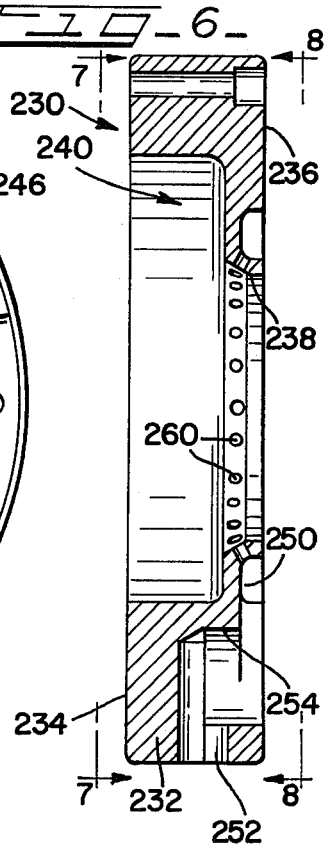
FIG. 6 is a cross-sectional view of the lubricant removal ring.
Figure 8:
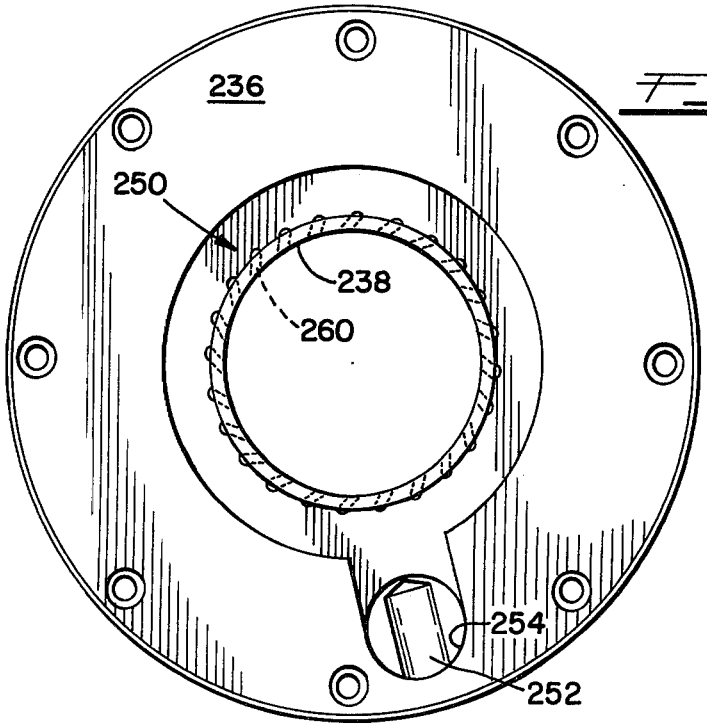
FIG. 8 is a plan view of the lubricant removal ring, as viewed along line 8—8 of FIG. 6.

According to one aspect of the invention, the third modular unit 34 also includes a unique lubricant removal means 230, the purpose of which will be described later. Lubricant removal means 230 (FIGS. 6–8) includes a main body 232 that has opposed generally parallel surfaces 234 and 236. An opening 238 extends through the body 232 and a liquid receiving channel 240 surrounds the opening 238. As illustrated in FIG. 7, the peripheral surface 242 of the channel or recess 240 has a minimum radius with respect to the center of opening 238 at a first point 244 and progressively increases in radial dimension from the first point 244 to a second point 246. Thus, the peripheral surface of the channel or recess is of a general spiral configuration between points 244 and 246. Channel or recess 240 has an outlet 248 extending therefrom to the periphery of the body between points 244 and 246.

Lubricant removal means or ring 230 also has a lubricant supply means in the form of a generally circular recess 250 extending from the surface 236 and surrounding opening 238. Recess or channel 250 has an inlet 252 which is connected thereto through an opening 254 to a supply conduit 256 (FIG. 2).

Lubricant supply means also includes a plurality of inclined circumferentially spaced openings 260 that extend around the periphery of opening 238 and are inclined a substantial amount with respect to the axis of the opening 238. As more clearly illustrated in FIG. 8, the respective openings, perferably being 24 in number, extend non-radially with respect to the center axis of opening 238. Thus, the lubricant-coolant is directed at a compound angle toward the surface of the cup on the punch because of the inclined relation of the openings with respect to the path of the punch and a tangential component of flow around the periphery of the cup is developed because of the non-radial nature of the openings with respect to the path. The openings 86, 156 and 215 in lubricating rings 82, 150 and 210 may also be positioned at a compound angle to the punch to produce a tangential component of flow or vortex around the cup or container shell and increase the heat transfer to the lubricant.

Lubricant supply means or ring 230 is secured within cavity 209 along with ironing die assembly 210 and support ring 222 through a plurality of screws to 268. As illustrated in FIG. 5 in the assembled condition, the adjacent surface guide member 220, more specifically support member 222 closes the exposed surface of channel 240 to provide a flow path for fluid around the perimeter of the cup (not shown), as will be described later.

Third modular unit 34 also has a fluid bearing supply means 269 identical to fluid bearing supply means 176 associated with ironing support ring 212. In addition, the support ring 212 is centered through centering springs 79. The third modular unit also has a pair of ears 126 secured to the peripheral surface.

The third modular unit also has a stripper assembly 330 associated therewith for removing the finished drawn and iron container shell from the punch while the punch is being retracted. The details of the stripper assembly are disclosed in co-pending application Ser. No. 900,272 filed Apr. 26, 1978, and incorporated herein by reference. Stripper assembly 300 includes a support element 332 having an opening 334 therethrough and a recess 336 extending from one surface thereof. A plurality of pivoted jaws 338 are located around the perimeter of opening 336 and the lower edges of the jaws 338 cooperate to define an opening 340 through which the finished container shell and punch pass during the last part of the stroke of the drawing and ironing process. The respective jaws or segments 338 are held in a predetermined position through a resilient support member 342 and a ring 344 as well as an elastomeric member 346, all supported by a support ring 348. The jaws are biased to a position wherein the opening 340 is slightly smaller than the peripheral diameter of the finished container shell which passes therethrough.

Support ring 348 and the elements supported thereon are biased to a centered position with respect to the path for the punch through suitable circumferentially spaced biasing means 360. The stripper assembly 330 is held in a fixed position on support member 200 through a plurality of screws 362. It should be noted that the peripheral surface of support element 332 has a diameter substantially equal to the diameter of a reduced portion 364 extending from the exposed surface of main body 202.

Thus, as the container shell and punch pass through the opening 340, the lower edges of the pivoted jaws are moved outwardly slightly to accommodate the movement of the container shell therethrough. However, after the upper free edge of the container shell moves beyond the lower edge of the pivoted jaws, the jaws will move inwardly into the path of return movement of the upper free edge of the container shell.

In assembling the respective modular units into the frame 12 of body maker 10, the third modular unit 34 is first inserted into cavity 18 adjacent the center portion thereof and the modular unit is moved axially of the path for punch 14 so that the reduced end portion, including support element 332 and reduced portion 364, is received into the circular recess 24 at the end of cavity 18. The modular unit 30 is then inserted into the cavity and moved axially in the opposite direction so that the reduced end portion, specifically the periphery of nesting ring 100 is received into the recess 22 defined at the opposite end of the cavity. The third modular unit 32 is then inserted between the two properly positioned modular units 30 and 34 to complete the tool pack assembly as illustrated in FIG. 2. During such assembly, the respective ears 126 may be utilized as gripping members for a gripping tool to manipulate the respective modular assemblies. After the three modular units or assemblies have been properly positioned as illustrated in FIG. 2, a cover is pivoted to the closed position and has spring assemblies that engage the peripheral surfaces of the respective modular units to securely lock the respective assemblies in a fixed position with respect to the path for the punch 14.

In the assembled condition illustrated in FIG. 1, the respective openings in the respective components of the three modular assemblies will define a path for a cup that is delivered through a cup supply means 320 where the cups C are engaged by redraw sleeve (not shown) and then are picked up by punch 14 and are moved axially through the respective modular units to initially redraw the cup to a smaller peripheral diameter surrounding punch 14 through the cooperation between the punch and the redraw ring 92. Subsequently, the punch cooperates with the first ironing ring or die 60 to reduce the wall thickness of the cup. Of course, the further reductions in the wall thickness will occur as the punch passes through ironing dies 144 and 214.

During such movement through the respective modular units, lubricant-coolant is continuously supplied through conduits 88, 155, 218 and 256. The lubricant supplied through conduits 88, 155 and 256 provide a means for lubrication as well as removing heat from the cup as it is being passed through the respective ironing dies 60 and 144. However, substantially all of the lubricant supplied to the periphery of the cup through conduits 88, 155 and 256 is removed through channel 240, passes through outlet 248 and is returned to the reservoir for the lubricant-coolant. Thus, only a small amount of lubricant that is delivered through conduit 218 flows through the outlet opening 340 thereby reducing the possibility of having sufficient lubricant in the finished container shell prior to the container shell being removed from the path for the punch after it has been stripped from the punch utilizing stripper assembly 330.

It should also be noted that during the movement of the punch with the cup thereon through the respective modular units, any misalignment that may occur between the ironing rings 60 and 144 and punch 14 will be accommodated by radial movement of the respective support assemblies which will compress the respective spring assemblies 79. In the event there is a large amount of misalignment such as caused by jams, between the punch and the respective ironing dies, the protective anvils 162, 170 and 224 will be in the path of the misaligned punch to prevent damage of the more expensive ironing dies.

In summary, the present invention provides a unique arrangement of the various components of a tool pack so that a plurality of components can be accurately positioned with respect to each other and the respective modular units can be inserted and removed in a very short period of time.

We claim:

1. In an ironing press having a main frame with a punch reciprocable along a path and having a cavity along said path with first and second recesses at opposite ends of said cavity, first, second and third modular units in said cavity defining a tool pack cooperating with said punch to reduce the wall thickness of a cup on said punch and strip said cup from said punch, said first modular unit including a first support member defining a chamber and having an ironing ring assembly and redraw ring assembly serially arranged in said chamber with a reduced portion of said redraw ring assembly extending from an end surface of said first support member, said reduced portion extending into one of said recesses to position said first modular unit with respect to said path, said first support member having a flat surface opposite said reduced portion extending substantially perpendicular to said path; said second modular unit including a second support member having a reduced peripheral portion of one end thereof, a stripper assembly secured to said support member and an ironing ring assembly in said support member, said reduced peripheral portion being received into the other of said recesses to position said support member with respect to said path said second support member having a flat surface opposite said reduced peripheral portion which extends substantially perpendicular to said path, and a third modular unit including a third support member having a third ironing ring assembly supported therein and having flat surfaces extending substantially perpendicular to said path on opposite ends thereof, said third support member being positioned into said cavity with the respective flat surfaces in extended engagement with the respective flat surfaces of said first and second support members.

2. An ironing press as defined in claim 1, in which each ironing ring assembly includes an ironing ring and a lubricating ring with means for supplying lubricant-coolant thereto and in which said second modular unit includes a lubricant removal means for removing substantially all of the lubricant supplied to said first and third modular units.

3. An ironing press as defined in claim 2, in which said lubricant removal means includes means for supplying lubricant to said path.

4. An ironing press as defined in claim 2, in which each lubricating ring includes means for directing said lubricant at a compound angle to the periphery of said punch.

5. A modular tool pack unit for use in an ironing machine having a punch reciprocable along a path to reduce the side wall thickness of a cup comprising an elongated support member, a stripper assembly supported by said support member and having movable segments defining an opening for said punch, an ironing die supported by said support member adjacent said stripper assembly and having an opening for said punch, lubricant distribution means supported by said support member adjacent said ironing die on a side opposite said stripper assembly, and lubricant removal means adjacent said lubricant distribution means for removing substantially all lubricant previously supplied to said path and said punch.

6. A modular tool pack unit for use in a drawing and ironing operation comprising a support member defining a chamber having a base end and an opposite open end, an ironing ring supported in said chamber on said base, a lubricating ring adjacent said ironing ring in said chamber and a redraw ring assembly supported on said lubricating ring with a portion of said redraw ring assembly extending beyond said open end to define an aligning and support portion.

7. A lubricant removal ring for use in a drawing and ironing operation comprising a main body having opposed generally parallel surfaces with a circular opening extending through said body between said surfaces for receiving a cup during the drawing and ironing operation, said body having a liquid receiving channel surrounding and exposed to the periphery of said opening, said channel having a minimum radial dimension at one point and having a progressively increasing radial dimension from said one point to a second point, and means defining an outlet extending from said channel to the periphery of said body between said points.

8. A lubricant removal ring as defined in claim 7, further including lubricant supply means surrounding said opening and spaced from said channel for supplying lubricant to said opening.

9. A lubricant removal ring as defined in claim 8, in which said lubricant supply means includes a channel in said body surrounding and spaced from said opening and a plurality of circumferentially spaced apertures between said lubricant channel and said opening, said apertures having axes located at a compound angle with respect to the axis of said opening.

10. In an ironing operation having a plurality of ironing die assemblies aligned with the path of a punch and cooperating therewith to reduce the wall thickness of a cup supported on said punch, the steps of flowing a lubricant to the surface of said cup adjacent the leading end of each ironing die assembly, and removing substantially all of the lubricant supplied to said cups upstreamed of the last of said ironing die assemblies.

11. An ironing operation as defined in claim 10, in which said lubricant is removed by a lubricant removal ring having a channel having a progressively increasing radial dimension around said path leading to an outlet and in which the lubricant for said last ironing die assemblies is supplied downstream of said lubricant removal ring.

* * * * *